US010824097B2

(12) United States Patent
Hatano et al.

(10) Patent No.: US 10,824,097 B2
(45) Date of Patent: Nov. 3, 2020

(54) DRUM CARTRIDGE AND IMAGE FORMING APPARATUS

(71) Applicant: BROTHER KOGYO KABUSHIKI KAISHA, Nagoya (JP)

(72) Inventors: Shuhei Hatano, Nagoya (JP); Koyo Yamamoto, Nisshin (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/582,119

(22) Filed: Sep. 25, 2019

(65) Prior Publication Data

US 2020/0103791 A1 Apr. 2, 2020

(30) Foreign Application Priority Data

Sep. 28, 2018 (JP) ..... 2018-183843

(51) Int. Cl.
*G03G 15/00* (2006.01)
*G03G 15/16* (2006.01)
*G03G 15/08* (2006.01)

(52) U.S. Cl.
CPC ..... *G03G 15/1655* (2013.01); *G03G 15/0808* (2013.01); *G03G 2215/025* (2013.01)

(58) Field of Classification Search
CPC ..... G03G 15/1655; G03G 15/0808; G03G 2215/025
See application file for complete search history.

(56) References Cited

U.S. PATENT DOCUMENTS

2006/0067734 A1* 3/2006 Igarashi ..... G03G 15/0178 399/119
2013/0084096 A1 4/2013 Hashimoto

FOREIGN PATENT DOCUMENTS

JP 2013-076877 A 4/2013

* cited by examiner

*Primary Examiner* — Clayton E. LaBalle
*Assistant Examiner* — Michael A Harrison
(74) *Attorney, Agent, or Firm* — Merchant & Gould P.C.

(57) ABSTRACT

A drum cartridge that is mountable to and demountable from a main body of an image forming apparatus, the drum cartridge including: a photosensitive drum rotatable about a first axis extending in a first direction; and a first conveying roller rotatable about a second axis extending in the first direction, the first conveying roller being in contact with a second conveying roller of the image forming apparatus and being configured to convey a sheet, which is sandwiched between the first conveying roller and the second conveying roller, toward the photosensitive drum in a state where the drum cartridge is mounted on the main body, in which the drum cartridge has a guide groove into which an end portion of the second conveying roller in the first direction is inserted in the state where the drum cartridge is mounted on the main body.

20 Claims, 8 Drawing Sheets

DRUM CARTRIDGE AND IMAGE FORMING APPARATUS

CROSS-REFERENCE TO RELATED APPLICATIONS

This application claims priority from Japanese Patent Application No. 2018-183843 filed on Sep. 28, 2018, the entire contents of which are incorporated herein by reference.

TECHNICAL FIELD

The present disclosure relates to a drum cartridge that is mountable to and demountable from a main body of an image forming apparatus and the image forming apparatus.

BACKGROUND

In prior arts, an image forming apparatus including a main body and a drum cartridge, which is mountable to and demountable from the main body, including a photosensitive drum and a drum frame configured to hold the photosensitive drum has been known. In this technique, the drum cartridge includes a first conveying roller, and the main body includes a second conveying roller. The first conveying roller is movable with respect to the drum frame. The main body includes a guide groove into which an end portion of the first conveying roller is inserted when the drum cartridge is mounted on the main body.

When the drum cartridge is mounted on the main body, the end portion of the first conveying roller is inserted into the guide groove. Therefore, a position of the first conveying roller is determined with respect to the second conveying roller.

SUMMARY

In order to stabilize sheet conveyance from between the first conveying roller and the second conveying roller toward the photosensitive drum, it is necessary to determine a position of the second conveying roller with respect to the photosensitive drum while determining a position of the first conveying roller with respect to the photosensitive drum.

An object of the present disclosure is to provide a drum cartridge and an image forming apparatus that can determine the position of the second conveying roller with respect to the photosensitive drum while determining the position of the first conveying roller with respect to the photosensitive drum.

In order to achieve the above object, the drum cartridge of the present disclosure, which is mountable to and demountable from a main body of an image forming apparatus, includes: a photosensitive drum rotatable about a first axis extending in a first direction; and a first conveying roller rotatable about a second axis extending in the first direction, the first conveying roller being in contact with a second conveying roller of the image forming apparatus and being configured to convey a sheet, which is sandwiched between the first conveying roller and the second conveying roller, toward the photosensitive drum in a state where the drum cartridge is mounted on the main body, in which the drum cartridge has a guide groove into which an end portion of the second conveying roller in the first direction is inserted in the state where the drum cartridge is mounted on the main body.

BRIEF DESCRIPTION OF DRAWINGS

FIG. 4A shows a first metal plate, and FIG. 4B shows a second metal plate;

FIG. 5A shows a first roller bearing, and FIG. 5B shows a second roller bearing;

FIG. 6A shows a second gear and a second conveying roller gear, and FIG. 6B shows a first gear and an auger gear;

DESCRIPTION OF EMBODIMENTS

Figure 1:
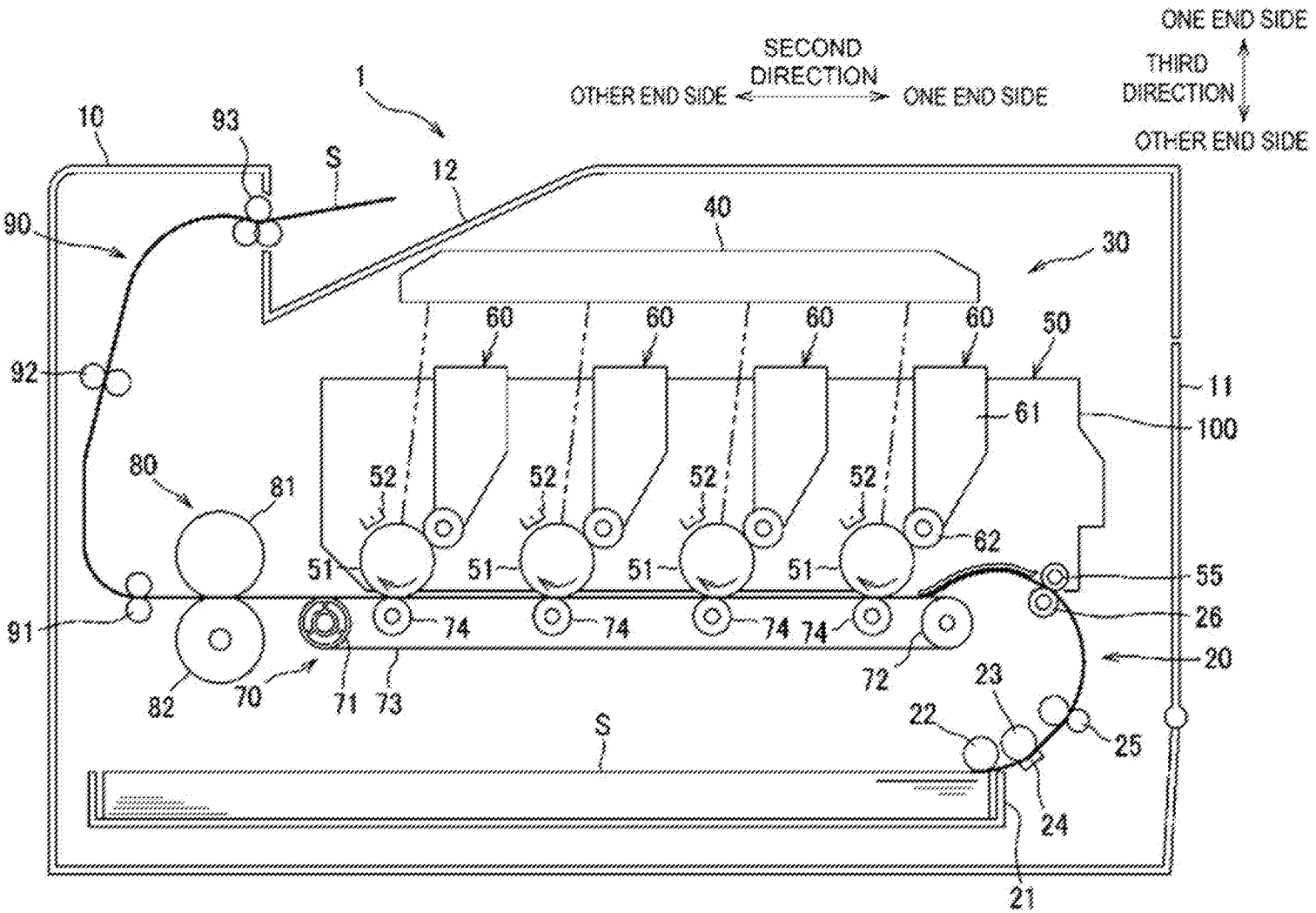
FIG. 1 shows a schematic configuration of an image forming apparatus according to an embodiment.

Next, an embodiment of the disclosure will be described in detail with reference to drawings. In the following description, an axial direction of a photosensitive drum 51 is defined as a first direction. A direction in which a plurality of the photosensitive drums 51 are aligned is defined as a second direction. The second direction intersects the first direction. Preferably, the second direction is orthogonal to the first direction. A direction in which a discharge tray 12, an image forming unit 30, and a sheet tray 21 are aligned is defined as a third direction. The third direction intersects the first direction and the second direction. Preferably, the third direction is orthogonal to the first direction and the second direction.

As shown in FIG. 1, an image forming apparatus 1 includes a main body 10, a sheet supply unit 20, the image forming unit 30, and a sheet discharge unit 90.

A cover 11 is located at one end side in the second direction in the main body 10. The discharge tray 12 is located at one end side in the third direction in the main body 10.

The sheet supply unit 20 includes the sheet tray 21, a pickup roller 22, a separating roller 23, a separating pad 24, a conveying roller 25, and a second conveying roller 26. The sheet tray 21 accommodate a sheet S such as paper. The sheet tray 21 is located at another end side in the third direction in the main body 10.

The pickup roller 22 feeds the sheet S in the sheet tray 21 toward the separating roller 23. The separating roller 23 and the separating pad 24 separate a plurality of sheets S one by one and convey the sheet S toward the image forming unit 30. The conveying roller 25 conveys the sheet S toward the image forming unit 30. The second conveying roller 26 is in contact with a first conveying roller 55 of a drum cartridge 50, which will be described below. In a state of being in contact with the first conveying roller 55, the second conveying roller 26 regulates a tip end position of the sheet S and supplies the sheet S to the image forming unit 30.

The image forming unit 30 includes an exposure device 40, the drum cartridge 50, a plurality of developing cartridges 60 aligned in the second direction, a transfer unit 70, and a fixing device 80.

The exposure device 40 is located at the one end side in the third direction in the main body 10. The exposure device 40 emits a light beam (see two-dot chain lines) to expose a surface of the photosensitive drum 51.

The drum cartridge 50 includes the plurality of the photosensitive drums 51 aligned in the second direction, a plurality of chargers 52 corresponding to the photosensitive drums 51, respectively, and a drum frame 100. When the cover 11 is opened, the drum cartridge 50 is mountable to and demountable from the main body 10 of the image forming apparatus 1 in the second direction. The drum cartridge 50 is located between the sheet tray 21 and the exposure device 40 in a state where the drum cartridge 50 is mounted on the main body 10.

The plurality of developing cartridges 60 is individually mountable to and demountable from the drum frame 100. The plurality of developing cartridges 60 is mountable to and demountable from the main body 10 together with the drum cartridge 50 in a state where the plurality of developing cartridges 60 are mounted on the drum cartridge 50. In other words, the drum cartridge 50 is mountable to and demountable from the main body 10 in a state where the plurality of developing cartridges 60 are mounted on the drum cartridge 50.

The developing cartridge 60 includes a developing housing 61 configured to accommodate developer, and a developing roller 62. The plurality of the developing cartridges 60 contain developer of different colors, respectively (for example, cyan, magenta, yellow, and black). The number of developing cartridges 60 mounted on the drum cartridge 50 of the present embodiment is four. However, the number of developing cartridges 60 mounted on the drum cartridge 50 may also be one to three, or five or more.

The transfer unit 70 is located between the sheet tray 21 and the drum cartridge 50. The transfer unit 70 includes a driving roller 71, a driven roller 72, a conveying belt 73, and a plurality of transfer rollers 74. The driving roller 71 and the driven roller 72 are separated in the second direction. The conveying belt 73 is an endless belt. The conveying belt 73 is stretched between the driving roller 71 and the driven roller 72. The transfer roller 74 is located inside the conveying belt 73. The transfer roller 74 sandwiches the conveying belt 73 with the photosensitive drum 51.

The fixing device 80 is further located at another end side in the second direction inside the main body 10 than the transfer unit 70. The fixing device 80 includes a heating roller 81 configured to heat the sheet S and a pressure roller 82 configured to press the heating roller 81.

The image forming unit 30 charges the surface of the photosensitive drum 51 by the charger 52. Next, the image forming unit 30 exposes the surface of the photosensitive drum 51 by the exposure device 40. Accordingly, the image forming unit 30 forms an electrostatic latent image on the photosensitive drum 51. Next, the image forming unit 30 supplies the developer to the photosensitive drum 51 from the developing roller 62. Accordingly, the image forming unit 30 visualizes the electrostatic latent image and forms a developer image on the photosensitive drum 51.

Next, the image forming unit 30 conveys the sheet S supplied from the sheet supply unit 20 to a position between the photosensitive drum 51 and the transfer roller 74. Accordingly, the image forming unit 30 transfers the developer image on the photosensitive drum 51 to the sheet S. Then, the image forming unit 30 conveys the sheet S to which the developer image is transferred to a position between the heating roller 81 and the pressure roller 82. Accordingly, the image forming unit 30 thermally fixes the developer image on the sheet S to form an image on the sheet S.

The sheet discharge unit 90 includes conveying rollers 91 and 92 and a discharge roller 93. The conveying rollers 91 and 92 convey the sheet S on which the image is formed toward the discharge roller 93. The discharge roller 93 discharges the sheet S onto the discharge tray 12 of the main body 10.

Figure 2:
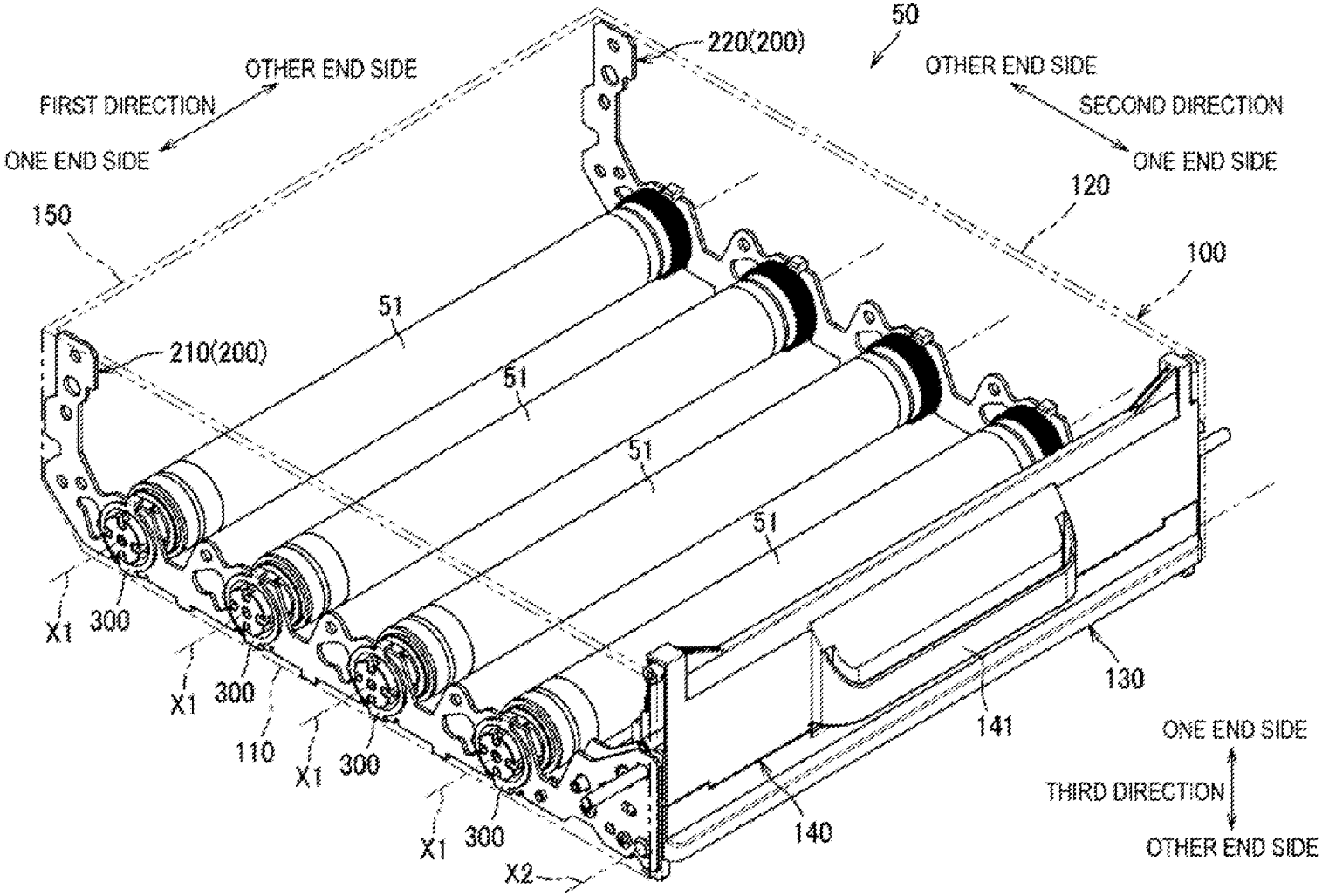
FIG. 2 is a perspective view of a drum cartridge according to the embodiment.
Figure 3:
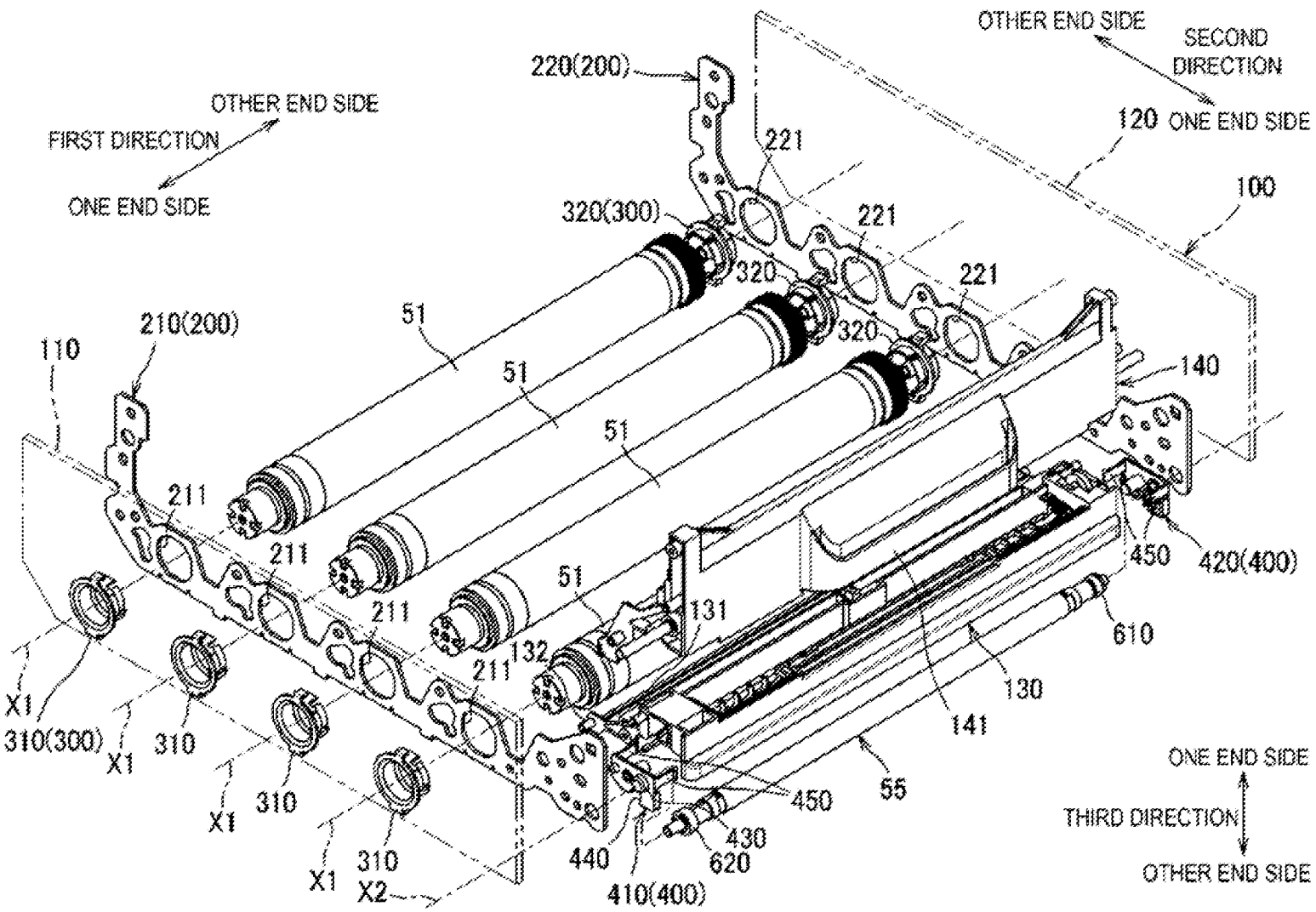
FIG. 3 is an exploded perspective view of the drum cartridge.

As shown in FIGS. 2 and 3, the drum cartridge 50 includes the plurality of the photosensitive drums 51, the first conveying roller 55, the drum frame 100, metal plates 200, a plurality of drum bearings 300 corresponding to the photosensitive drums 51, respectively, and roller bearings 400.

The drum frame 100 supports the photosensitive drum 51 and the first conveying roller 55 via the metal plates 200. The drum frame 100 is made of resin. The drum frame 100 includes a first side frame 110, a second side frame 120, a first connecting frame 130, a second connecting frame 140, and a third connecting frame 150. The first connecting frame 130 is an example of a connecting frame.

The first side frame 110 is located at one end portion of the photosensitive drum 51 in the first direction. The second side frame 120 is located at another end portion of the photosensitive drum 51 in the first direction. The first side frame 110 and the second side frame 120 are located outside the metal plates 200 in the first direction. The first side frame 110 and the second side frame 120 cover the metal plates 200. The first side frame 110 and the second side frame 120 are fixed to the metal plates 200.

The first connecting frame 130, the second connecting frame 140, and the third connecting frame 150 are located between the first side frame 110 and the second side frame 120.

The first connecting frame 130 and the second connecting frame 140 are located at one end portion of the drum frame 100 in the second direction. The first connecting frame 130 extends in the first direction so as to connect one end portion of the first side frame 110 in the second direction and one end portion of the second side frame 120 in the second direction. The second connecting frame 140 extends in the first direction so as to connect the one end portion of the first side frame 110 in the second direction and the one end portion of the second side frame 120 in the second direction.

The first connecting frame 130 includes a first protrusion 131 and a second protrusion 132. The first protrusion 131 and the second protrusion 132 protrude outward in the first direction from a side surface of the first connecting frame 130 in the first direction. Each of the first protrusion 131 and the second protrusion 132 has a cylindrical shape.

Figure 5A:
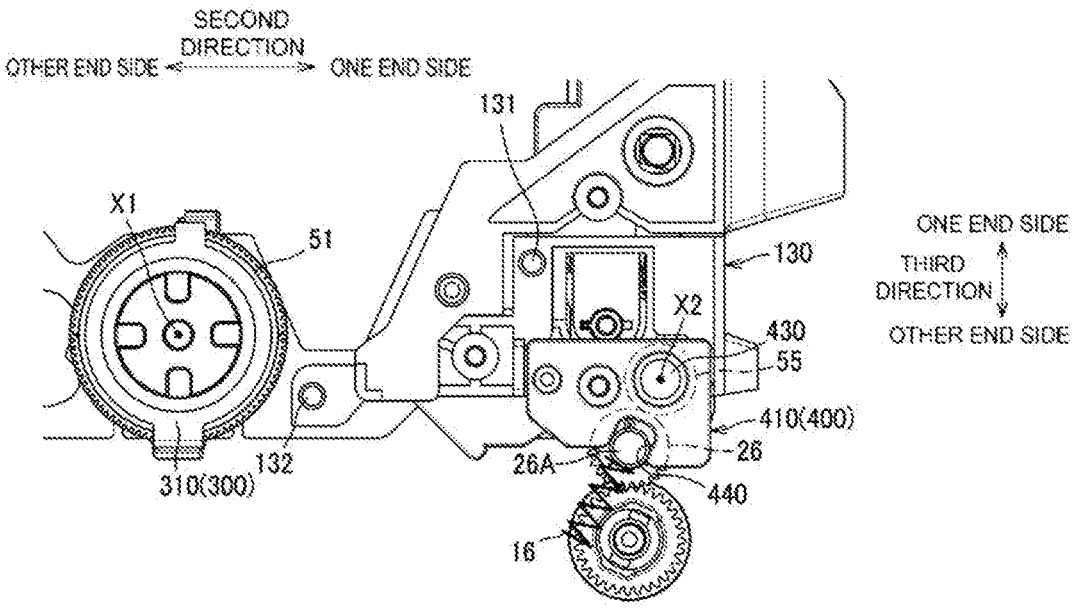
FIGS. 5A and 5B show the one end portion of the drum cartridge in the second direction when viewed from the first direction.
Figure 5B:
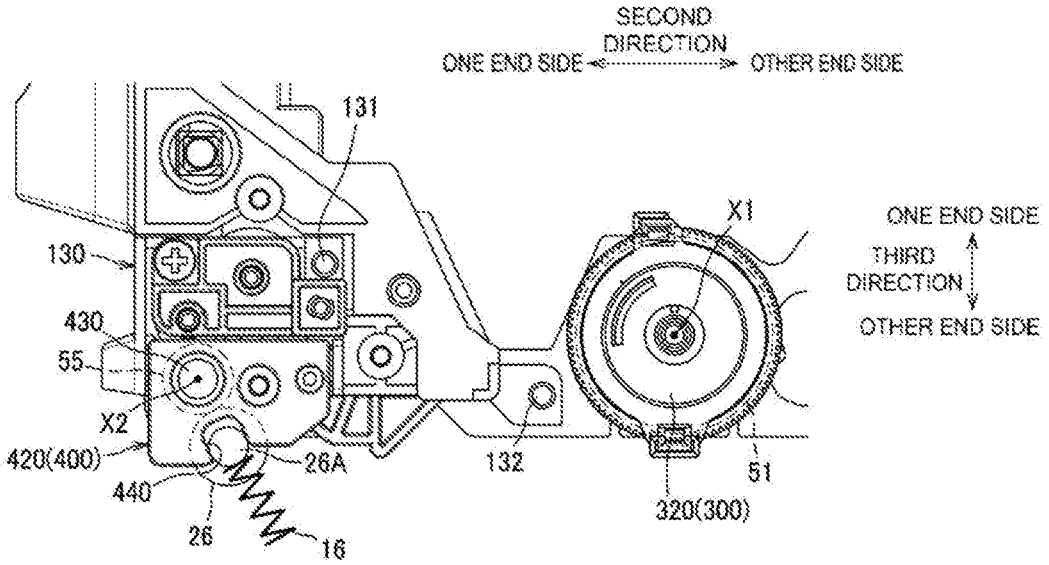

As shown in FIGS. 5A and 5B, each of the first protrusion 131 and the second protrusion 132 is located at one end portion and another end portion of the first connecting frame 130 in the first direction.

Figure 7:
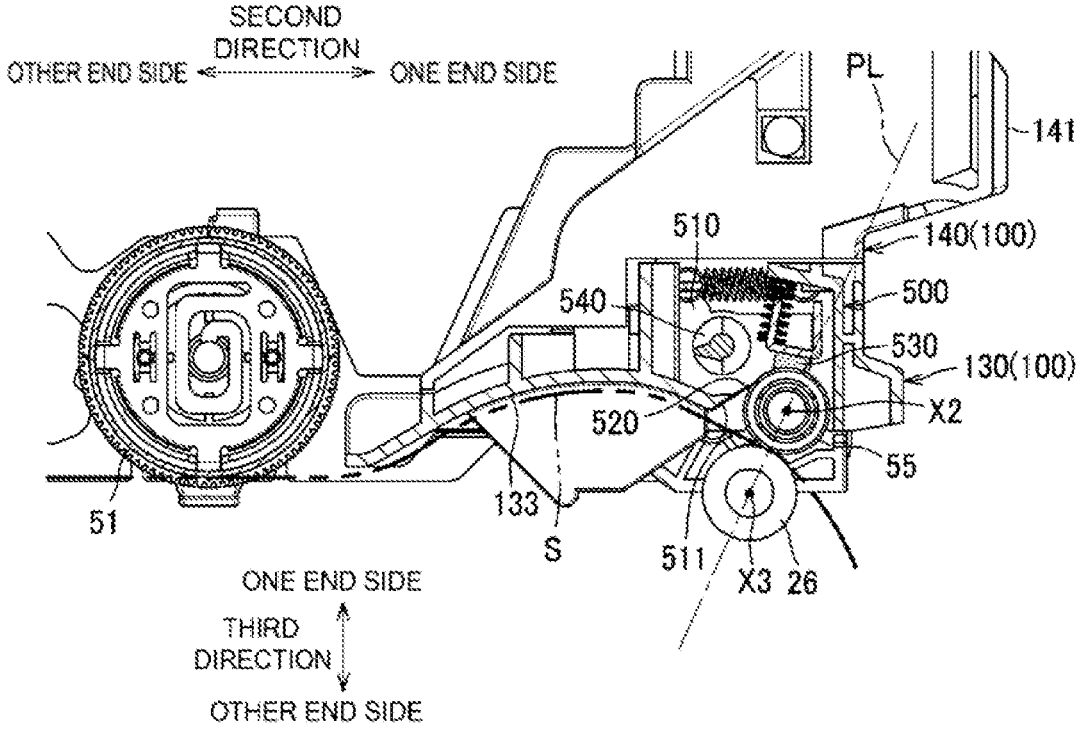
FIG. 7 is a cross-sectional view showing a sheet guide surface and a cleaning unit.

As shown in FIG. 7, the first connecting frame 130 includes a sheet guide surface 133. The sheet guide surface 133 guides the sheet S conveyed to the position between the photosensitive drum 51 and the conveying belt 73 (see FIG. 1) from between the first conveying roller 55 and the second conveying roller 26. The sheet guide surface 133 is a substantially arc-shaped surface.

As shown in FIG. 2, the second connecting frame 140 is located at one end side of the first connecting frame 130 in the third direction. The second connecting frame 140 includes a handle 141. The handle 141 is grasped by a user when the drum cartridge 50 is mounted to the main body 10 or the drum cartridge 50 is demounted from the main body 10. The handle 141 is located at the one end portion of the drum frame 100 in the second direction.

The third connecting frame 150 is located at the other end portion of the drum frame 100 in the second direction. The third connecting frame 150 extends in the first direction so as to connect the other end portion of the first side frame 110 in the second direction and the other end portion of the second side frame 120 in the second direction.

The metal plates 200 support the photosensitive drum 51 and the first conveying roller 55. The metal plates 200 are made of sheet metal. The metal plates 200 include a first metal plate 210 and a second metal plate 220. The first metal plate 210 is located at the one end portion of the photosensitive drum 51 in the first direction. The second metal plate 220 is located at the other end portion of the photosensitive drum 51 in the first direction.

Figure 4A:
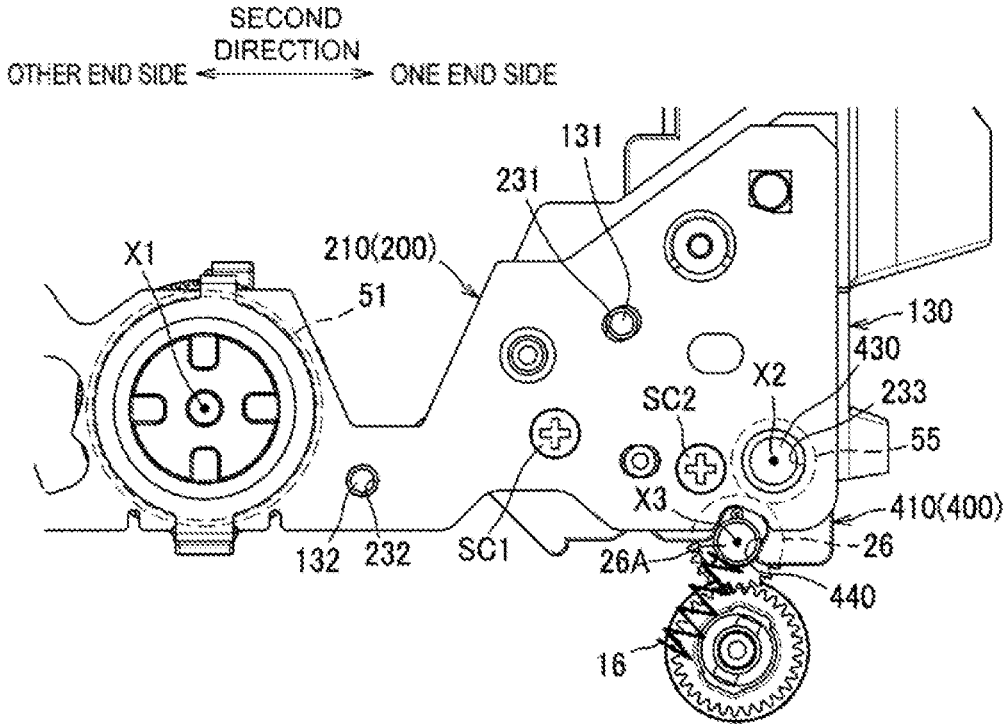
FIGS. 4A and 4B show one end portion of the drum cartridge in a second direction when viewed from a first direction.
Figure 4B:
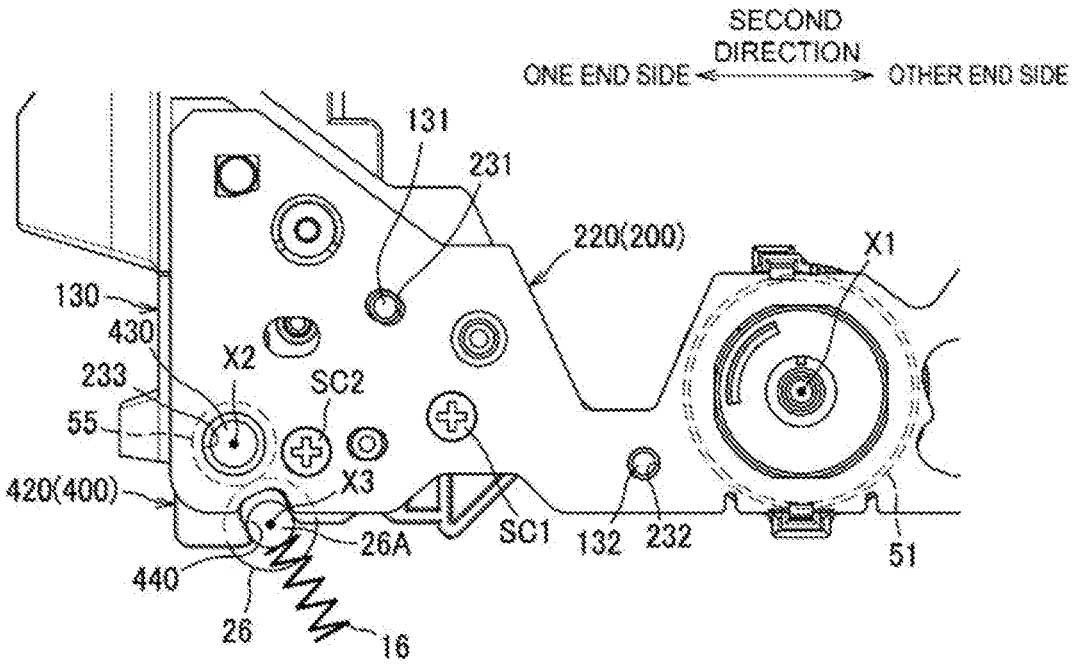

The first connecting frame 130 of the drum frame 100 is fixed to the first metal plate 210 and the second metal plate 220. Specifically, as shown in FIGS. 4A and 4B, each of the first metal plate 210 and the second metal plate 220 has a first hole 231 and a second hole 232. The first hole 231 is an oval hole penetrating in the first direction. The second hole 232 is a circular hole penetrating in the first direction. The first protrusion 131 of the first connecting frame 130 can be inserted into the first hole 231. The second protrusion 132 of the first connecting frame 130 can be inserted into the second hole 232.

The first connecting frame 130 is fixed to the metal plates 200 by a screw SC1 in a state where the first protrusion 131 is inserted into the first hole 231 of the metal plates 200 and the second protrusion 132 is inserted into the second hole 232 of the metal plates 200. Accordingly, the metal plates 200 determine a position of the first connecting frame 130. Specifically, the metal plates 200 determine a position of the sheet guide surface 133 (see FIG. 7).

As shown in FIG. 3, the photosensitive drum 51 is rotatable about a first axis X1 extending in the first direction. The photosensitive drum 51 is rotatably supported by the drum bearings 300 with respect to the metal plates 200 and the drum frame 100.

The drum bearings 300 are made of resin. The drum bearings 300 include first drum bearings 310 and second drum bearings 320. The first drum bearings 310 are located at the one end portion of the photosensitive drum 51 in the first direction. The first drum bearings 310 rotatably support the one end portion of the photosensitive drum 51 in the first direction. The second drum bearings 320 are located at the other end portion of the photosensitive drum 51 in the first direction. The second drum bearings 320 rotatably support the other end portion of the photosensitive drum 51 in the first direction.

The first drum bearings 310 are fixed to the first metal plate 210. Specifically, the first metal plate 210 includes a plurality of first fixing holes 211 aligned in the second direction. The first drum bearings 310 are inserted into corresponding first fixing holes 211, respectively, from the outside of the first metal plate 210 in the first direction and are fixed to the first metal plate 210.

The second drum bearings 320 are fixed to the second metal plate 220. Specifically, the second metal plate 220 includes a plurality of second fixing holes 221 aligned in the second direction. The second drum bearings 320 are inserted into corresponding second fixing holes 221, respectively, from the inside of the second metal plate 220 in the first direction and are fixed to the second metal plate 220.

Accordingly, the metal plates 200 determine a position of each photosensitive drum 51 by the first drum bearings 310 and the second drum bearings 320.

The first conveying roller 55 is rotatable about a second axis X2 extending in the first direction. As shown in FIG. 1, the first conveying roller 55 is located at the one end of the drum frame 100 in the second direction. The first conveying roller 55 is in contact with the second conveying roller 26 of the sheet supply unit 20 of the image forming apparatus 1 in the state where the drum cartridge 50 is mounted on the main body 10. The first conveying roller 55 sandwiches the sheet S with the second conveying roller 26 and conveys the sheet S toward a position between the photosensitive drum 51 and the conveying belt 73. Referring back to FIG. 3, the first conveying roller 55 is rotatably supported by the roller bearings 400 with respect to the metal plates 200 and the drum frame 100.

The roller bearings 400 are made of resin. The roller bearings 400 are located between the first side frame 110 and the second side frame 120 in the first direction. The roller bearings 400 are located between the first metal plate 210 and the second metal plate 220 in the first direction. The roller bearings 400 are located at end portions of a shaft of the first conveying roller 55 in the first direction. The roller bearings 400 rotatably support the shaft of the first conveying roller 55. The roller bearings 400 include a first roller bearing 410 and a second roller bearing 420.

The first roller bearing 410 is located at one end portion of the shaft of the first conveying roller 55 in the first direction. The first roller bearing 410 rotatably supports the one end portion of the shaft of the first conveying roller 55 in the first direction. The first roller bearing 410 is located between the first side frame 110 and the first connecting frame 130 in the first direction. The first roller bearing 410 is located between the first metal plate 210 and the first connecting frame 130 in the first direction. Therefore, the first metal plate 210 is located between the first roller bearing 410 and the first side frame 110 in the first direction.

The second roller bearing 420 is located at the other end portion of the shaft of the first conveying roller 55 in the first direction. The second roller bearing 420 rotatably supports the other end portion of the shaft of the first conveying roller 55 in the first direction. The second roller bearing 420 is located between the second side frame 120 and the first connecting frame 130 in the first direction. The second roller bearing 420 is located between the second metal plate 220 and the first connecting frame 130 in the first direction. Therefore, the second metal plate 220 is located between the second roller bearing 420 and the second side frame 120 in the first direction.

As shown in FIGS. 5A and 5B, each of the roller bearings 400, that is, each of the first roller bearing 410 and the second roller bearing 420 has a bearing protrusion 430 and a guide groove 440.

The bearing protrusion 430 is a collar that rotatably supports the end portion of the shaft of the first conveying roller 55. The bearing protrusion 430 protrudes outward in the first direction from a side surface of the roller bearing 400 in the first direction. The bearing protrusion 430 has a bottomed cylindrical shape.

The guide groove 440 is a groove into which an end portion of a shaft 26A of the second conveying roller 26 in the first direction is inserted in the state where the drum cartridge 50 is mounted on the main body 10 of the image forming apparatus 1. The guide groove 440 linearly extends from an edge of the roller bearing 400 on the other end side in the third direction toward a rotation center of the first conveying roller 55 (the second axis X2). The guide groove 440 extends obliquely so as to be located at one end side in the second direction from the other end side in the third direction toward the one end side in the third direction.

As shown in FIG. 4A, the first roller bearing 410 is fixed to the first metal plate 210. As shown in FIG. 4B, the second roller bearing 420 is fixed to the second metal plate 220. Specifically, each of the first metal plate 210 and the second metal plate 220 includes a third hole 233. The third hole 233 is a circular hole penetrating in the first direction. The bearing protrusion 430 of the roller bearing 400 can be inserted into the third hole 233.

The first roller bearing 410 and the second roller bearing 420 are temporarily fixed to the first connecting frame 130 by a pair of claws 450 (see FIG. 3) while inserting the bearing projections 430 into the end portions of the shaft of the first conveying roller 55 in the first direction. The first roller bearing 410 is fixed to the first metal plate 210 by a screw SC2 in a state where the bearing protrusion 430 is inserted into the third hole 233 of the first metal plate 210. The second roller bearing 420 is fixed to the second metal plate 220 by the screw SC2 in a state where the bearing protrusion 430 is inserted into the third hole 233 of the second metal plate 220.

The metal plates 200 determine a position of the first conveying roller 55 by the first roller bearing 410 and the second roller bearing 420. The metal plates 200 determine positions of components relating to the conveyance of the sheet S. Specifically, the metal plates 200 determine positions of the first conveying roller 55, the first connecting frame 130, and the photosensitive drum 51. More specifically, the metal plates 200 determine positions of the first conveying roller 55, the sheet guide surface 133 (see FIG. 7), and the photosensitive drum 51.

The first conveying roller 55 is immovably supported with respect to the drum frame 100. More specifically, as described above, the roller bearings 400 that rotatably support the first conveying roller 55 are fixed to the metal plates 200. Accordingly, the first conveying roller 55 is fixed to the drum frame 100 by the roller bearings 400 and the metal plates 200 in a manner that the position of the first conveying roller 55 does not change with respect to the drum frame 100.

The second conveying roller 26 is rotatable about a third axis X3 extending in the first direction. The main body 10 of the image forming apparatus 1 rotatably supports the second conveying roller 26 directly or supports the second conveying roller 26 by a bearing (not shown), for example. That is, the sheet supply unit 20 of the image forming apparatus 1 includes the second conveying roller 26. The second conveying roller 26 includes the shaft 26A extending in the first direction.

The second conveying roller 26 is movably supported with respect to the main body 10. Specifically, the shaft 26A of the second conveying roller 26 is supported by the main body 10 so as to be movable linearly along the guide grooves 440 of the roller bearings 400. Specifically, the shaft 26A of the second conveying roller 26 is movable linearly in a direction approaching or separating with respect to the shaft (the second axis X2) of the first conveying roller 55.

The image forming apparatus 1 includes a spring 16. The spring 16 presses the end portion of the shaft 26A of the second conveying roller 26 in the first direction toward the first conveying roller 55. In the state where the drum cartridge 50 is mounted on the main body 10 of the image forming apparatus 1, the second conveying roller 26 is urged to the first conveying roller 55 by a pressing force of the spring 16. Although a coil spring is shown as the spring 16 in the drawings, a type of the spring is not particularly limited.

As shown in FIG. 7, the first conveying roller 55 is configured to collect paper dust from the sheet S conveyed between the first conveying roller 55 and the second conveying roller 26. For example, when a bias having a polarity opposite to charging characteristics of the paper dust is applied to the first conveying roller 55, the paper dust on the sheet S is electrically attracted and collected.

The drum cartridge 50 includes a cleaning unit 500. The cleaning unit 500 removes the paper dust collected by the first conveying roller 55 from the first conveying roller 55 and accommodates the paper dust. The cleaning unit 500 includes a paper dust accommodating portion 510, a film 520, a paper dust removing member 530, and an auger 540.

The paper dust accommodating portion 510 accommodates the paper dust collected by the first conveyor roller 55. The paper dust accommodating portion 510 has walls on both sides in the first direction, walls on both sides in the second direction, and walls on both sides in the third direction. Specifically, the first connecting frame 130 of the drum frame 100 has the walls on the both sides in the first direction, the walls on the both sides in the second direction, and a wall on the other end side in the third direction of the paper dust accommodating portion 510. The second connecting frame 140 of the drum frame 100 has a wall on the one end side in the third direction of the paper dust accommodating portion 510.

The paper dust accommodating portion 510 includes a paper dust receiving inlet 511 located at the wall on the other end side in the third direction. The paper dust receiving inlet 511 is an opening configured to receive the paper dust collected by the first conveying roller 55. The first conveying roller 55 is located at the paper dust receiving inlet 511.

The paper dust accommodating portion 510 is located at an opposite side of the second conveying roller 26 in the third direction to sandwich the first conveying roller 55 therebetween. The paper dust accommodating portion 510 is located at a side closer to the photosensitive drum 51 with reference to a plane PL passing through the rotation center of the first conveying roller 55 (the second axis X2) and a rotation center of the second conveying roller 26 (the third axis X3). In other words, the paper dust accommodating portion 510 is located at the other end side of the plane PL in the second direction.

The film 520 closes a gap between the first conveying roller 55 and an edge portion of the paper dust receiving inlet 511. The film 520 is made of resin. One end portion of the film 520 is fixed to the edge portion of the paper dust receiving inlet 511. Another end of the film 520 is in contact with a surface of the first conveying roller 55.

The paper dust removing member 530 contacts the first conveying roller 55 and removes paper dust from the first conveying roller 55. The paper dust removing member 530 is made of sponge. The paper dust removing member 530 is located inside the paper dust accommodating portion 510. The paper dust removing member 530 is fixed to the first connecting frame 130. Paper dust collected by the first conveying roller 55 is scraped off by the paper dust removing member 530 and accommodated in the paper dust accommodating portion 510.

Figure 8:
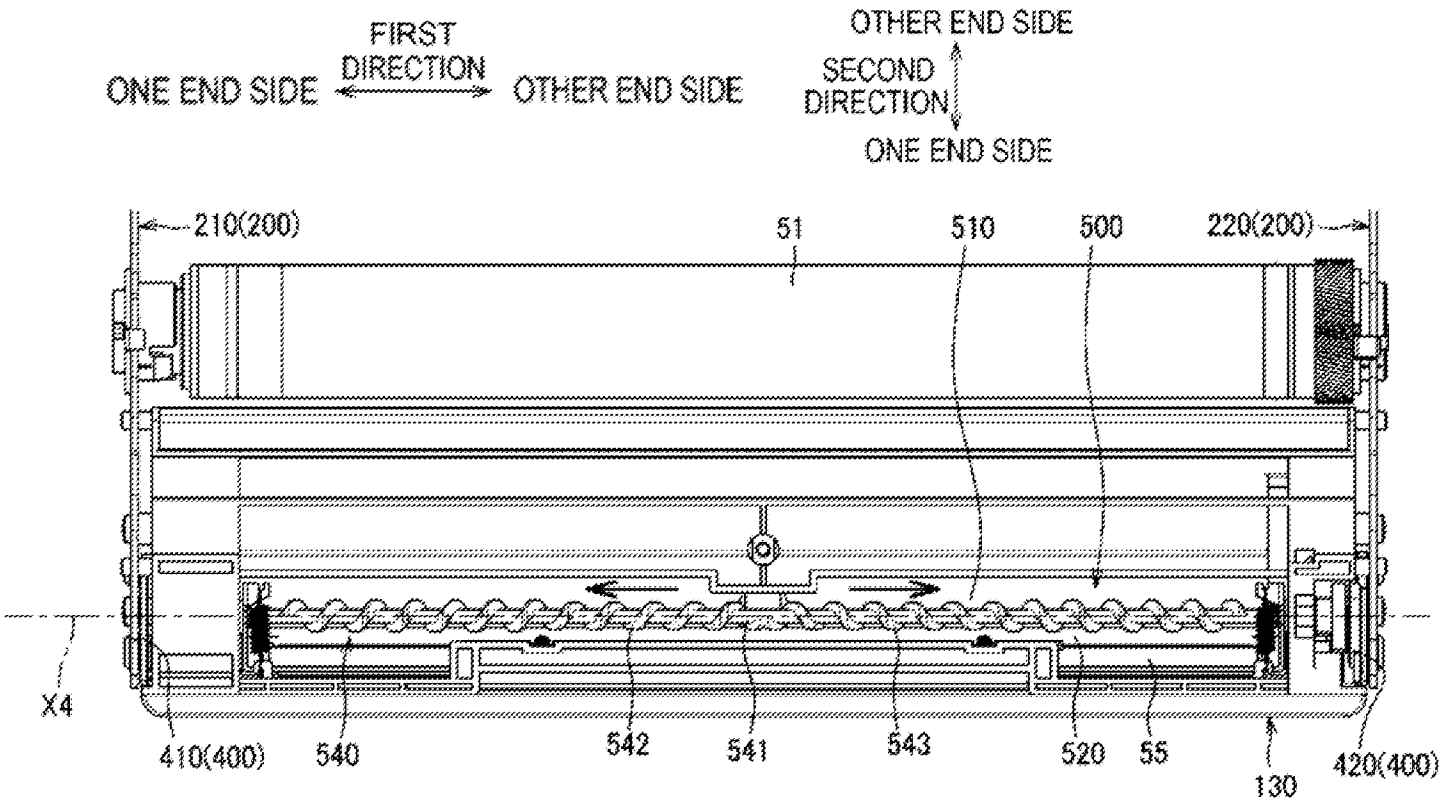
FIG. 8 is a view of the cleaning unit when viewed from one end side in a third direction.

The auger 540 is configured to convey the paper dust accommodated in the paper dust accommodating portion 510. The auger 540 is located inside the paper dust accommodating portion 510. As shown in FIG. 8, the auger 540 includes an auger shaft 541 extending in the first direction, a first blade 542 and a second blade 543 which are spirally formed around the auger shaft 541. The auger shaft 541 is rotatably supported by the first connecting frame 130 about a fourth axis X4 extending in the first direction.

The first blade 542 is located at one end side of the auger shaft 541 in the first direction. The first blade 542 is configured to convey the paper dust toward the one end side in the first direction by rotation of the auger shaft 541. The second blade 543 is located at another end side of the auger shaft 541 in the first direction. The second blade 543 is configured to convey the paper dust toward the other end side in the first direction by the rotation of the auger shaft 541. Accordingly, the auger 540 is configured to convey the paper dust accommodated in the paper dust accommodating portion 510 from the vicinity of the center of the first conveying roller 55 in the first direction toward the one end and the other end of the first conveying roller 55 in the first direction.

Figure 6A:
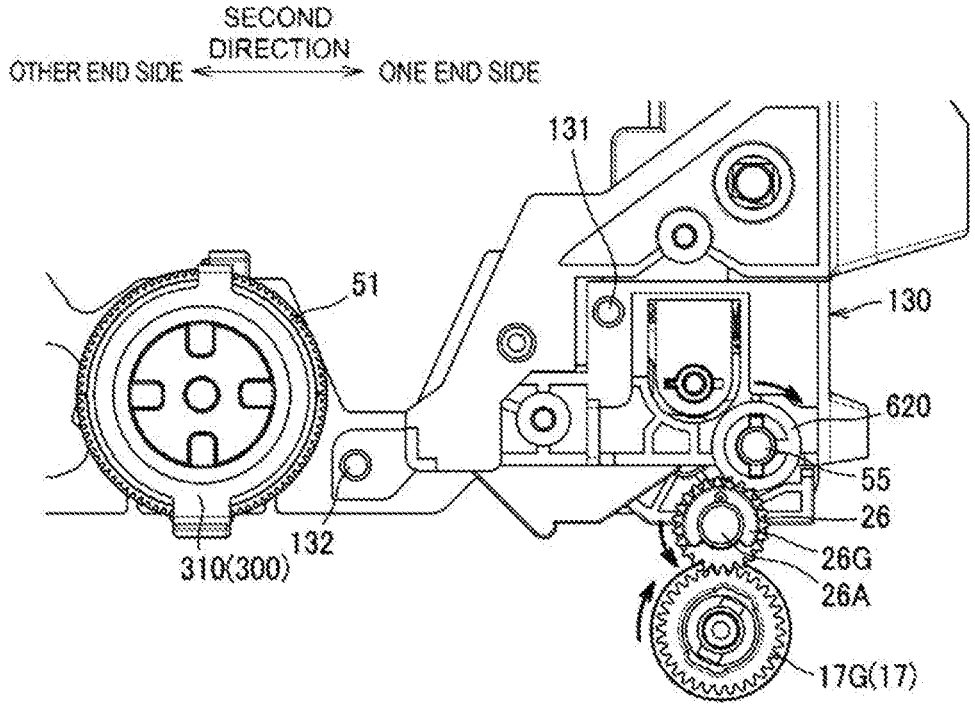
FIGS. 6A and 6B show the one end portion of the drum cartridge in the second direction when viewed from the first direction.
Figure 6B:
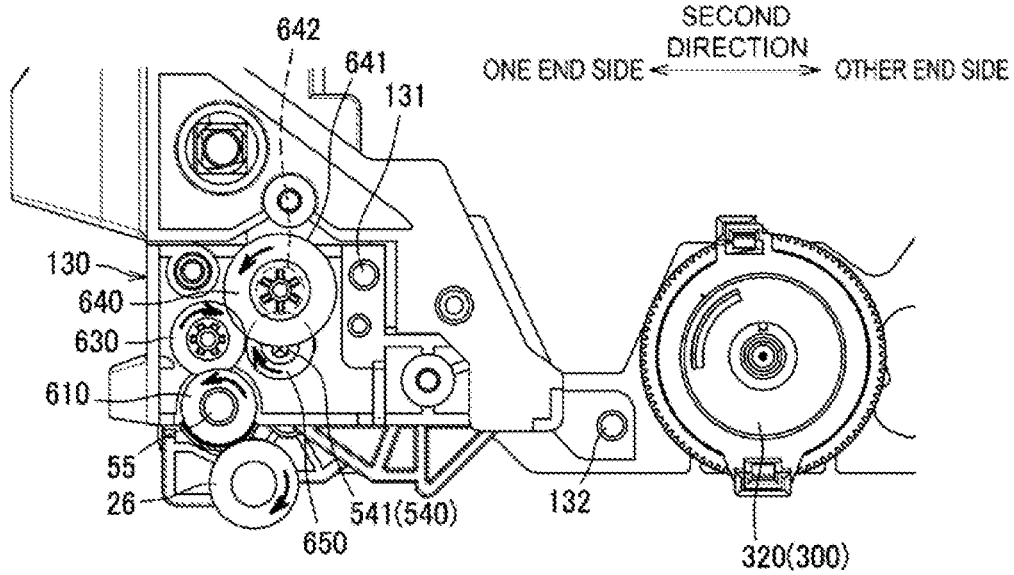

As shown in FIGS. 6A and 6B, the drum cartridge 50 includes a first gear 610, a second gear 620, a first idle gear 630, a second idle gear 640, and an auger gear 650.

As shown in FIG. 6A, the second gear 620 is located at the one end portion of the first conveying roller 55 in the first direction. The second gear 620 is fixed to the one end portion of the shaft of the first conveying roller 55 in the first direction. The second gear 620 is configured to be engaged with a second conveying roller gear 26G of the sheet supply unit 20 (the image forming apparatus 1) in the state where the drum cartridge 50 is mounted on the main body 10.

The second conveying roller gear 26G is located at an end portion of the second conveying roller 26 in the first direction, which is on the same side as the one end portion of the first conveying roller 55 at which the second gear 620 is located. Specifically, the second conveying roller gear 26G is located at the one end portion in the first direction. The second conveying roller gear 26G is fixed to the one end portion of the shaft 26A of the second conveying roller 26 in the first direction. Therefore, the image forming apparatus 1 includes the second conveying roller gear 26G. The image forming apparatus 1 is provided with a driving device 17 including a motor (not shown) and a plurality of gears, such as an output gear 17G. The second conveying roller gear 26G is engaged with the output gear 17G. The second conveying roller gear 26G receives a driving force from the driving device 17.

As shown in FIG. 5A, the first roller bearing 410 is located at the one end portion of the first conveying roller 55 in the first direction to which the second gear 620 is fixed. As shown in FIG. 4A, the first metal plate 210 is located at the one end side of the first roller bearing 410 in the first direction. Therefore, the first roller bearing 410 is located between the second gear 620 and the first metal plate 210 in the first direction.

As shown in FIG. 6B, the first gear 610 is located at the other end portion of the first conveying roller 55 in the first direction. The first gear 610 is fixed to the other end portion of the shaft of the first conveying roller 55 in the first direction.

The first idle gear 630 and the second idle gear 640 are rotatably supported on a side surface on the other end side of the first connecting frame 130 in the first direction. The first idle gear 630 is engaged with the first gear 610. The second idle gear 640 includes a large-diameter gear portion 641 and a small-diameter gear portion 642 located at one end side of the large-diameter gear portion 641 in the first direction. The large-diameter gear portion 641 of the second idle gear 640 is engaged with the first idle gear 630.

The auger gear 650 is located at an end portion of the auger 540 in the first direction, which is on the same side as the other end portion of the first conveying roller 55 at which the first gear 610 is located. Specifically, the auger gear 650 is located at the other end portion in the first direction. The auger gear 650 is fixed to the other end portion of the auger shaft 541 of the auger 540 in the first direction. The auger gear 650 is engaged with the small-diameter gear portion 642 of the second idle gear 640. Accordingly, the auger gear 650 receives a driving force from the first gear 610 via the first idle gear 630 and the second idle gear 640.

As shown in FIG. 5B, the second roller bearing 420 is located at the other end portion of the first conveying roller 55 in the first direction to which the first gear 610 is fixed. As shown in FIG. 4B, the second metal plate 220 is located at the other end side of the second roller bearing 420 in the first direction. Therefore, the second roller bearing 420 is located between the first gear 610 and the second metal plate 220 in the first direction.

When the drum cartridge 50, configured as described above, is being mounted to the main body 10, the drum cartridge 50 is moved from the one end side toward the other end side in the second direction, and the end portion of the shaft 26A of the second conveying roller 26 enters the guide groove 440 as shown in FIGS. 5A and 5B. When the drum cartridge 50 is further moved to the other end side in the second direction, the end portion of the shaft 26A is moved closer to the first conveying roller 55 along the guide groove 440 by the pressing force of the spring 16.

Then, when the drum cartridge 50 is further moved to the other end side in the second direction, the second conveying roller 26 comes into contact with the first conveying roller 55. Then, the drum cartridge 50 is mounted on the main body 10. At this time, the end portion of the shaft 26A of the second conveying roller 26 which is in contact with the first conveying roller 55 is inserted into the guide groove 440, and is urged toward the first conveying roller 55 by the spring 16. Accordingly, a position of the second conveying roller 26 is determined in the second direction and the third direction. Accordingly, the position of the second conveying roller 26 is determined with respect to the first conveying roller 55 and the photosensitive drum 51.

As shown in FIG. 6A, when the second conveying roller gear 26G receives the driving force from the output gear 17G of the driving device 17, the second conveying roller gear 26G is rotated. Then, when the second conveying roller gear 26G rotates, the second gear 620 is rotated. Accordingly, the first conveying roller 55 and the second conveying roller 26 are rotated.

At this time, when a driving force generated by rotation of the second gear 620 is transmitted via the shaft of the first conveying roller 55, the first gear 610 is rotated as shown in FIG. 6B. Accordingly, the auger gear 650 is rotated via the first idle gear 630 and the second idle gear 640. Accordingly, the auger 540 is rotated.

Referring back to FIGS. 5A and 5B, when the drum cartridge 50 is being detached from the main body 10, the drum cartridge 50 is moved from the other end side to the one end side in the second direction, and the end portion of the shaft 26A of the second conveying roller 26 is pressed on a surface of the guide groove 440 on the other end side in the second direction. Accordingly, the second conveying roller 26 is moved to the other end side in the third direction against a pressing force of the spring 16. Then, when the drum cartridge 50 is further moved to the one end side in the second direction, the shaft 26A of the second conveying roller 26 is moved out from the guide groove 440. Accordingly, a user can detach the drum cartridge 50 from the main body 10.

According to the present embodiment described above, since both the photosensitive drum 51 and the first conveying roller 55 are provided in the drum cartridge 50, a position of the first conveying roller 55 can be determined with respect to the photosensitive drum 51. Since the end portion of the shaft 26A of the second conveying roller 26 is inserted into the guide groove 440 of the drum cartridge 50 in the state where the drum cartridge 50 is mounted on the main body 10 of the image forming apparatus 1, the position of the second conveying roller 26 of the sheet supply unit 20 of the image forming apparatus 1 can be determined with respect to the first conveying roller 55 of the drum cartridge 50. Accordingly, the position of the second conveying roller 26 can be determined with respect to the photosensitive drum 51, as the position of the first conveying roller 55 is also determined with respect to the photosensitive drum 51.

Accordingly, since positional relationships between the photosensitive drum 51, the first conveying roller 55, and the second conveying roller 26 can be favorably maintained, conveyance of the sheet S from between the first conveying roller 55 and the second conveying roller 26 toward the photosensitive drum 51 can be stabilized.

Since the drum cartridge 50 includes the first conveying roller 55, the positions of the first conveying roller 55 and the second conveying roller 26 can be located at the one end side in the third direction. That is, the positions of the first conveying roller 55 and the second conveying roller 26 in the third direction can be separated from the sheet tray 21. Accordingly, a curved shape of a conveyance path of the sheet S can be made gentle from the sheet tray 21 toward a position between the initial photosensitive drum 51 and the conveying belt 73. Accordingly, the sheet S can be favorably conveyed from the sheet supply unit 20 toward the image forming unit 30.

Since the roller bearing 400 has the guide groove 440, a member rotatably supporting the first conveying roller 55 and a member having the guide groove 440 can be integrated. Accordingly, since position determination accuracy of the second conveying roller 26 with respect to the first conveying roller 55 can be improved, the position of the second conveying roller 26 can be accurately determined with respect to the photosensitive drum 51.

Since the first roller bearing 410 and the first drum bearing 310 are fixed to the first metal plate 210 and the second roller bearing 420 and the second drum bearing 320 are fixed to the second metal plate 220, position determination accuracy of the photosensitive drum 51 and the first conveying roller 55 can be improved. Accordingly, the position of the first conveying roller 55 can be accurately determined with respect to the photosensitive drum 51. Accordingly, the position of the second conveying roller 26, which is determined with respect to the first conveying roller 55, can be accurately determined with respect to the photosensitive drum 51.

Since the photosensitive drum 51, the first conveying roller 55, and the first connecting frame 130 including the sheet guide surface 133, are fixed to the first metal plate 210 and the second metal plate 220, position determination accuracy of the sheet guide surface 133 with respect to the photosensitive drum 51 and the first conveying roller 55 can be improved. Accordingly, the sheet S can be favorably guided from between the first conveying roller 55 and the second conveying roller 26 toward the photosensitive drum 51.

Since the first conveying roller 55 is configured to collect paper dust from the sheet S, the paper dust can be collected from the sheet S before the photosensitive drum 51. Accordingly, deterioration in image quality caused by an influence of the paper dust can be prevented.

Since the drum cartridge 50 includes the cleaning unit 500 including the paper dust accommodating portion 510, the paper dust can be collected when replacing the drum cartridge 50. Accordingly, the main body 10 of the image forming apparatus 1 is not necessarily provided with a paper dust accommodating portion.

Since the main body 10 is not necessarily provided with the paper dust accommodating portion, it is not necessary for a path of mounting and demounting the drum cartridge 50 to avoid the paper dust accommodating portion of the main body 10.

Since the paper dust accommodating portion 510 is located at the other end side in the second direction with respect to the plane PL passing through the rotation center of the first conveying roller 55 and the rotation center of the second conveying roller 26, the paper dust accommodating portion 510 can be prevented from protruding to the one end side of the drum frame 100 in the second direction. Further, the paper dust accommodating portion 510 can be prevented from protruding to the other end side of the handle 141 in the third direction.

Since the cleaning unit 500 includes the film 520 closing the gap between the first conveying roller 55 and the edge portion of the paper dust receiving inlet 511 of the paper dust accommodating portion 510, the film 520 can prevent the paper dust stored in the paper dust accommodating portion 510 from leaking to the outside from the paper dust receiving inlet 511.

Since the cleaning unit 500 includes the paper dust removing member 530, the paper dust adhered to the first conveying roller 55 can be positively removed.

Since the auger 540 of the cleaning unit 500 is configured to convey the paper dust accommodated in the paper dust accommodating portion 510 from the vicinity of the center toward the one end portion and the other end portion in the first direction, the paper dust stored in the paper dust accommodating portion 510 can be prevented from accumulating in the vicinity of the center in the first direction. When the sheet S is conveyed in the vicinity of the center in the first direction in the main body 10, the paper dust is likely to accumulate in the vicinity of the center of the paper dust accommodating portion 510 in the first direction, thus, such a configuration is particularly effective.

Since the drum cartridge 50 includes the first gear 610 and the auger gear 650 configured to receive the driving force from the first gear 610, the auger 540 can be driven by inputting a driving force to the first conveying roller 55.

Since the drum cartridge 50 includes the second gear 620 configured to be engaged with the second conveying roller gear 26G, the first conveying roller 55 and the auger 540 can be driven by inputting a driving force to the second conveying roller 26 of the sheet supply unit 20 of the image forming apparatus 1.

Since the first conveying roller 55 is immovably supported with respect to the drum frame 100, the position of the first conveying roller 55 can be accurately determined with respect to the photosensitive drum 51. Accordingly, the position of the second conveying roller 26, which is determined with respect to the first conveying roller 55, can be accurately determined with respect to the photosensitive drum 51.

Although one embodiment of the present disclosure is described above, the present disclosure is not limited to the above-described embodiment, and can be appropriately modified and implemented.

For example, the cleaning unit is not limited to the configuration of the above-described embodiment. Specifically, the paper dust removing member may be a blade, a roller, or the like that scrapes off paper dust being in contact with the first conveying roller. The cleaning unit may not include the film as long as the paper dust does not easily leak from the paper dust accommodating portion. The cleaning unit may not include the auger.

The drum cartridge may not include the cleaning unit by itself. That is, the main body of the image forming apparatus may include the paper dust accommodating portion. The first conveying roller may not collect paper dust from the sheet.

In the above-described embodiment, the drum cartridge 50 includes the first gear 610, the second gear 620, and the auger gear 650, but the present disclosure is not limited thereto. For example, the drum cartridge may not include the second gear, and the first gear or the auger gear may receive a driving force from the image forming apparatus. The first gear may be engaged with a gear of the second conveying roller. The drum cartridge may not include the first gear and the auger gear, and the first conveying roller and the auger may receive driving forces independently.

In the embodiment described above, the roller bearing 400 has the guide groove 440, but the present disclosure is not limited thereto. For example, each of the first side frame and the second side frame of the drum frame may include the guide groove.

In the embodiment described above, the drum cartridge 50 and the image forming apparatus 1 used for color printing that include a plurality of photosensitive drums 51 are exemplified as the drum cartridge and the image forming apparatus, but the present disclosure is not limited thereto. For example, the drum cartridge and the image forming apparatus may be used for monochrome printing and include only one photosensitive drum. The image forming apparatus may be a printer, may be a composite machine that includes an original reading device (such as a flatbed scanner), or may be a copying machine.

Elements described in the embodiment and the modifications described above can be appropriately combined and implemented.

What is claimed is:

1. A drum cartridge that is mountable to and demountable from a main body of an image forming apparatus, the drum cartridge comprising:

a photosensitive drum rotatable about a first axis extending in a first direction; and a first conveying roller rotatable about a second axis extending in the first direction, the first conveying roller being in contact with a second conveying roller of the image forming apparatus and being configured to convey a sheet, which is sandwiched between the first conveying roller and the second conveying roller, toward the photosensitive drum in a state where the drum cartridge is mounted on the main body; and a roller bearing located at an end portion of the first conveying roller in the first direction, the roller bearing rotatably supporting the first conveying roller, wherein the roller bearing has a guide groove into which an end portion of the second conveying roller in the first direction is inserted in the state where the drum cartridge is mounted on the main body.

2. The drum cartridge according to claim 1, further comprising:

a drum frame supporting the photosensitive drum and the first conveying roller, wherein the first conveying roller is located at one end portion of the drum frame in a second direction intersecting the first direction.

3. The drum cartridge according to claim 2, wherein the first conveying roller is immovably supported with respect to the drum frame.

4. The drum cartridge according to claim 2, further comprising:

a plurality of the photosensitive drums are aligned in the second direction.

5. The drum cartridge according to claim 2, wherein the drum cartridge is mountable to the main body in the second direction.

6. The drum cartridge according to claim 1, further comprising:

a drum frame supporting the photosensitive drum and the first conveying roller, wherein the first conveying roller is located at one end portion of the drum frame in a second direction intersecting the first direction, wherein the drum frame includes a first side frame located at one end portion of the photosensitive drum in the first direction and a second side frame located at another end portion of the photosensitive drum in the first direction, and wherein the roller bearing is located between the first side frame and the second side frame in the first direction.

7. The drum cartridge according to claim 6, wherein the roller bearing includes a first roller bearing located at one end portion of the first conveying roller in the first direction and a second roller bearing located at another end portion of the first conveying roller in the first direction, and wherein the drum cartridge further comprises:

a first metal plate located at the one end portion of the photosensitive drum in the first direction and located between the first roller bearing and the first side frame in the first direction; and a second metal plate located at the other end portion of the photosensitive drum in the first direction and located between the second roller bearing and the second side frame in the first direction.

8. The drum cartridge according to claim 7, further comprising:

a first drum bearing located at the one end portion of the photosensitive drum in the first direction, the first drum bearing rotatably supporting the photosensitive drum; and a second drum bearing located at the other end portion of the photosensitive drum in the first direction, the second drum bearing rotatably supporting the photosensitive drum, wherein the first roller bearing and the first drum bearing are fixed to the first metal plate, and wherein the second roller bearing and the second drum bearing are fixed to the second metal plate.

9. The drum cartridge according to claim 8, wherein the drum frame includes a connecting frame located between the first side frame and the second side frame and located at the one end portion of the drum frame in the second direction, the connecting frame having a sheet guide surface configured to guide a sheet conveyed from the first conveying roller toward the photosensitive drum, and wherein the connecting frame is fixed to the first metal plate and the second metal plate.

10. The drum cartridge according to claim 7, wherein the first conveying roller is configured to collect paper dust from a sheet.

11. The drum cartridge according to claim 10, further comprising:

a cleaning unit including:

a paper dust accommodating portion configured to accommodate paper dust collected by the first conveying roller, the paper dust accommodating portion including a paper dust receiving inlet configured to receive the paper dust collected by the first conveying roller; and a film closing a gap between the first conveying roller and an edge portion of the paper dust receiving inlet.

12. The drum cartridge according to claim 11, wherein the cleaning unit includes a paper dust removing member being in contact with the first conveying roller so as to remove paper dust from the first conveying roller.

13. The drum cartridge according to claim 11, wherein the cleaning unit includes an auger configured to convey the paper dust accommodated in the paper dust accommodating portion from a center of the first conveying roller in the first direction toward the one end portion and the other end portion of the first conveying roller in the first direction.

14. The drum cartridge according to claim 13, further comprising:

a first gear located at the other end portion of the first conveying roller in the first direction; and an auger gear located at an end portion of the auger in the first direction, the end portion of the auger being on a same side as the other end portion of the first conveying roller at which the first gear is located, wherein the auger gear is configured to receive a driving force from the first gear.

15. The drum cartridge according to claim 14, wherein the second roller bearing is located between the first gear and the second metal plate in the first direction.

16. The drum cartridge according to claim 14, further comprising:

a second gear located at the one end portion of the first conveying roller in the first direction, the second gear being configured to be engaged with a second conveying roller gear located at an end portion of the second conveying roller in the first direction, the end portion of the second conveying roller being on a same side as the one end portion of the first conveying roller at which the second gear is located.

17. The drum cartridge according to claim 16, wherein the first roller bearing is located between the second gear and the first metal plate in the first direction.

18. An image forming apparatus comprising:

a main body;

a second conveying roller movably supported with respect to the main body; and a drum cartridge that is mountable to and demountable from the main body, the drum cartridge including;

a photosensitive drum rotatable about a first axis extending in a first direction; and a first conveying roller rotatable about a second axis extending in the first direction, the first conveying roller being in contact with the second conveying roller and being configured to convey a sheet, which is sandwiched between the first conveying roller and the second conveying roller, toward the photosensitive drum, wherein the drum cartridge has a guide groove into which an end portion of the second conveying roller in the first direction is inserted.

19. The image forming apparatus according to claim 18, further comprising: a spring configured to press the second conveying roller toward the first conveying roller.

20. A drum cartridge that is mountable to and demountable from a main body of an image forming apparatus, the drum cartridge comprising:

a photosensitive drum rotatable about a first axis extending in a first direction;

a first conveying roller rotatable about a second axis extending in the first direction, the first conveying roller being in contact with a second conveying roller of the image forming apparatus and being configured to convey a sheet, which is sandwiched between the first conveying roller and the second conveying roller, toward the photosensitive drum in a state where the drum cartridge is mounted on the main body;

a roller bearing located at an end portion of the first conveying roller in the first direction, the roller bearing rotatably supporting the first conveying roller;

a first side frame located at one end portion of the photosensitive drum in the first direction; and a second side frame located at another end portion of the photosensitive drum in the first direction, wherein the roller bearing is located between the first side frame and the second side frame in the first direction, and wherein the first side frame has a guide groove into which an end portion of the second conveying roller in the first direction is inserted in the state where the drum cartridge is mounted on the main body.

* * * * *